US011607593B2

(12) United States Patent
Hatchett

(10) Patent No.: US 11,607,593 B2
(45) Date of Patent: Mar. 21, 2023

(54) OSCILLATING TOSS GAME

(71) Applicant: Benny Lee Hatchett, Stratford, CT (US)

(72) Inventor: Benny Lee Hatchett, Stratford, CT (US)

(73) Assignee: B+D and Son LLC, Stratford, CT (US)

( * ) Notice: Subject to any disclaimer, the term of this patent is extended or adjusted under 35 U.S.C. 154(b) by 0 days.

(21) Appl. No.: 16/503,552

(22) Filed: Jul. 4, 2019

(65) Prior Publication Data

US 2021/0001194 A1 Jan. 7, 2021

(51) Int. Cl.
*A63B 67/06* (2006.01)

(52) U.S. Cl.
CPC ..... *A63B 67/06* (2013.01)

(58) Field of Classification Search
CPC ..... A63F 9/0204; A63F 9/02; A63B 67/06; A63B 2067/063; A63B 63/00
USPC ..... 273/369, 398–402
See application file for complete search history.

(56) References Cited

U.S. PATENT DOCUMENTS

| | | | | |
|---|---|---|---|---|
| 5,765,832 | A * | 6/1998 | Huff | A63B 63/08 273/354 |
| 2010/0244384 | A1* | 9/2010 | Hoffer | A63B 63/06 273/342 |
| 2018/0085649 | A1* | 3/2018 | O'Neill | A63B 65/00 |

* cited by examiner

*Primary Examiner* — John E Simms, Jr.
*Assistant Examiner* — Rayshun K Peng

(57) ABSTRACT

This present application pertains to a toss game consisting of at least two angled boards with a geometrically shaped cut out for the tossed item to fall through. It also consists of a mechanism that will move the geometrically shaped cut out, or opening, in an oscillating geometric motion, thus increasing the skill required to play said toss game.

3 Claims, 9 Drawing Sheets

OSCILLATING TOSS GAME

BACKGROUND OF INVENTION

Field of Invention

Toss games have been in existence for many years and are well known in the public domain. Sometimes toss games are called Corn Hole because the bags that are tossed were filled with corn meal or seeds. This invention pertains to the opening in the board itself through which the bag is tossed. In current configurations of said toss game the opening is fixed. This invention allows the opening to move in an oscillating geometric motion that increases the challenge of the toss game.

Description of Prior Art

Toss games, utilizing a type of bean bag, filled with a plurality of different substances, that competitors use to toss bean bags into an opening in a board, are well known in the prior art.

U.S. Pat. No. 4,938,485 to Hockridge sets forth a game that changes the stationary opening shape to multiple geometric stationary shapes to vary the degree of difficulty of the game.

U.S. Pat. No. 4,943,065 to DeLapa sets forth a foldable, collapsible Toss game for ease of storage and transportation. Also, it adds the possibility of the main target board being flexible and allowing the bean bag to bounce into the opening in the board.

U.S. Pat. No. 7,607,666 to Studier sets forth a game that is weather proof, collapses and folds upon itself, and includes a score board to enhance the experience to the competitors.

U.S. Pat. No. 7,237,777 to Digges makes the Toss game modular in its embodiment for ease of transportation.

U.S. Pat. No. 8,157,265 to K. Conville and D. Conville sets forth a game that comprises a foldable deployable target assembly and stabilizing assemblies linked to target assemblies.

U.S. Pat. No. 8,807,569 to Davis sets forth a game that illuminates said game. It also adds sound to the experience which when a bag goes through the hole a sound is emitted.

It is evident that there is a continual need for new, improved and challenging Toss games.

SUMMARY OF INVENTION

As stated previously, this invention pertains to the opening in the board which puts it into an oscillating geometric motion. To achieve this goal there are a plurality of mechanisms to accomplish this function. This invention describes four possible embodiments, but it is not limited to these four. The embodiments herein described commonly have a Sub-Board that is stationary and mounted to frame components to give a stable base. Also commonly there is a Top Board that is in an oscillating geometric motion. All embodiments show a device to induce motion, slides and a linkage to drive the Top Board into an oscillating geometric motion. Each embodiment has specific linkage designs to create a different oscillating geometric motion.

BRIEF DESCRIPTION OF FIGURES

To further satisfy the recited claims, a detailed description of possible embodiments are provided with reference drawings included that do not limit the scope of the invention.

DESCRIPTION OF THE INVENTION

The present invention shown here may be embodied in other specific forms without departing from its spirit or essential characteristics. The four embodiments herein are shown to address some of the different embodiments, but are not intended to limit the scope of the invention. Therefore the scope of the invention is indicated by the claims and their combination, in whole or in part, rather than the foregoing description.

Figure 1:
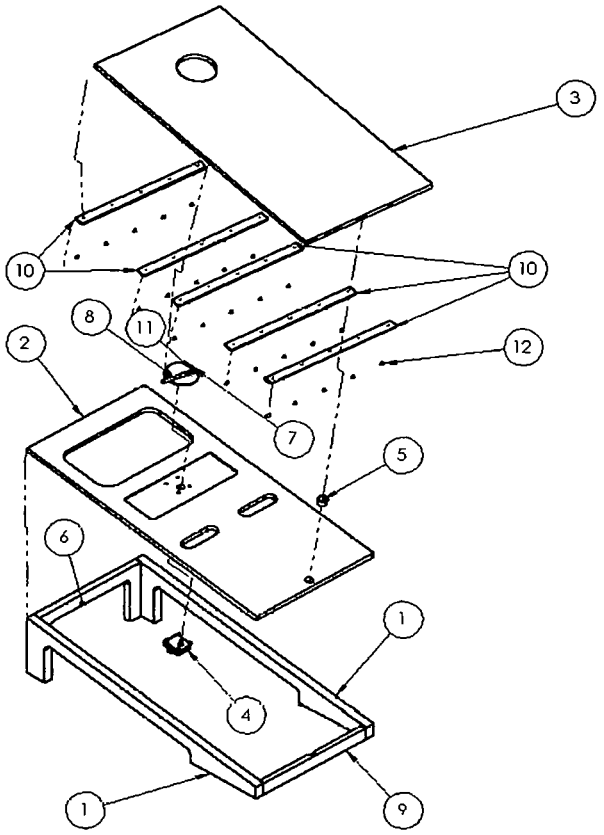
FIG. 1 is an exploded assembly depicting the "Arc" oscillating motion with item call-outs.
Figure 1A:
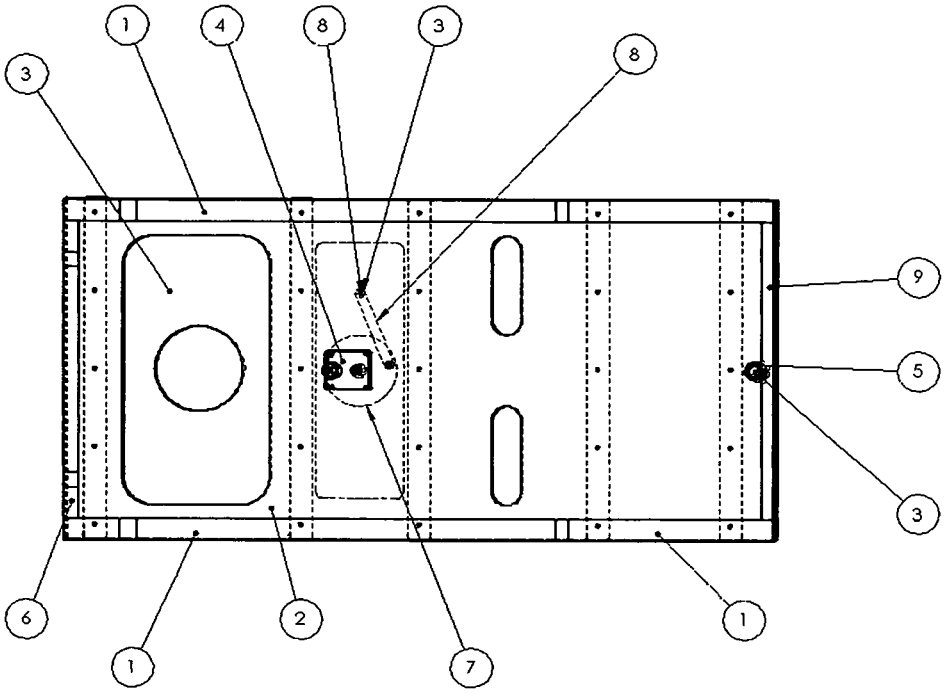
FIG. 1A is the bottom view of the "Arc" assembly with call-outs.
Figure 1B:
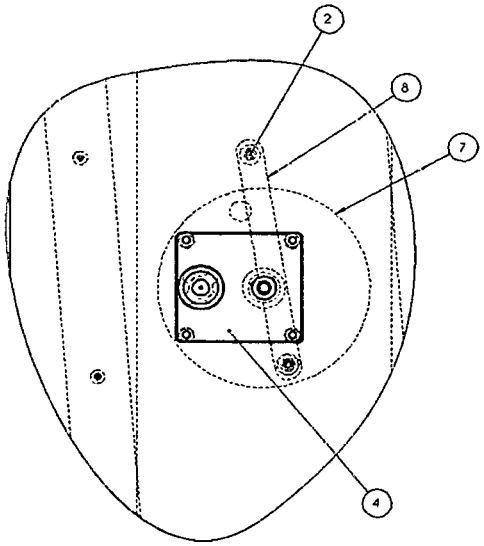
FIG. 1B is a detailed view of the linkage design that results in the "Arc" oscillating motion with call-outs.

The invention provides the means to make the circular shaped opening in the Top Board move in a single oscillating geometric motion. FIG. 1 shows the exploded view of the embodiment which results in an oscillating "Arc" motion. In FIG. 1A, Item 7, Flywheel, is attached to the output shaft of Item 4, Motor, to induce a rotary motion of Flywheel. Item 4, Motor, is mounted and fixed to Item 2, Sub Board. The Flywheel is joined to Item 8, Link, which allows relational circular motion between Flywheel and Link, and drives the Link smoothly in a circular motion. The opposite end of the Link is connected to the protruding pin in Item 3, Top Board, which allows relational circular motion and drives the Top Board. The Top Board has a protruding pin at the base of the Top Board, which aligns with Item 5, Bearing-Flanged, 1" ID, which is mounted in a hole in the Sub Board, which allows free rotational motion. All these elements together create an Oscillating Arc motion of the circular shaped opening in the Top Board to allow the bag to fall through. Also, the Top Board has a plurality of Item 10, Bar-Slide, Short, which are made from a low friction material to allow smooth motion. Item 2, Sub Board, has large cut-out in it to allow a bag to fall through easily throughout the single oscillation motion of the Top Board.

Figure 2:
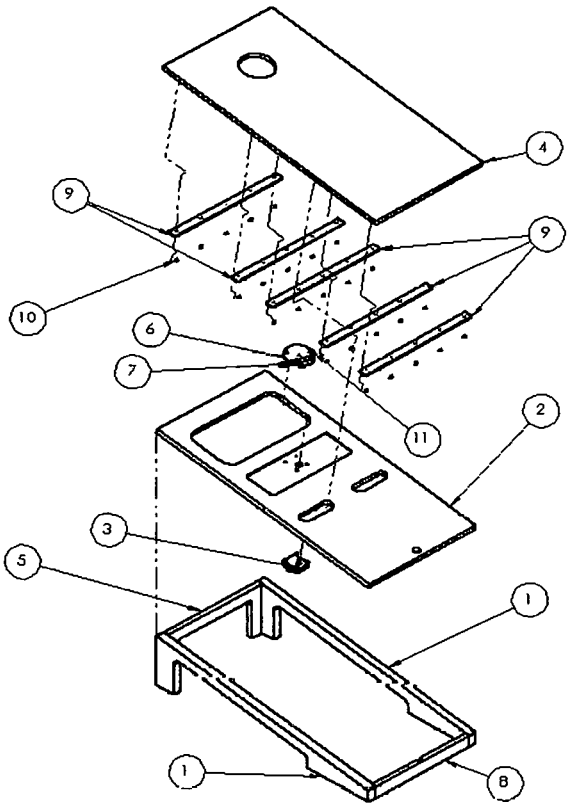
FIG. 2 is an exploded assembly depicting the "Horizontal" oscillating motion with item call-outs.
Figure 2A:
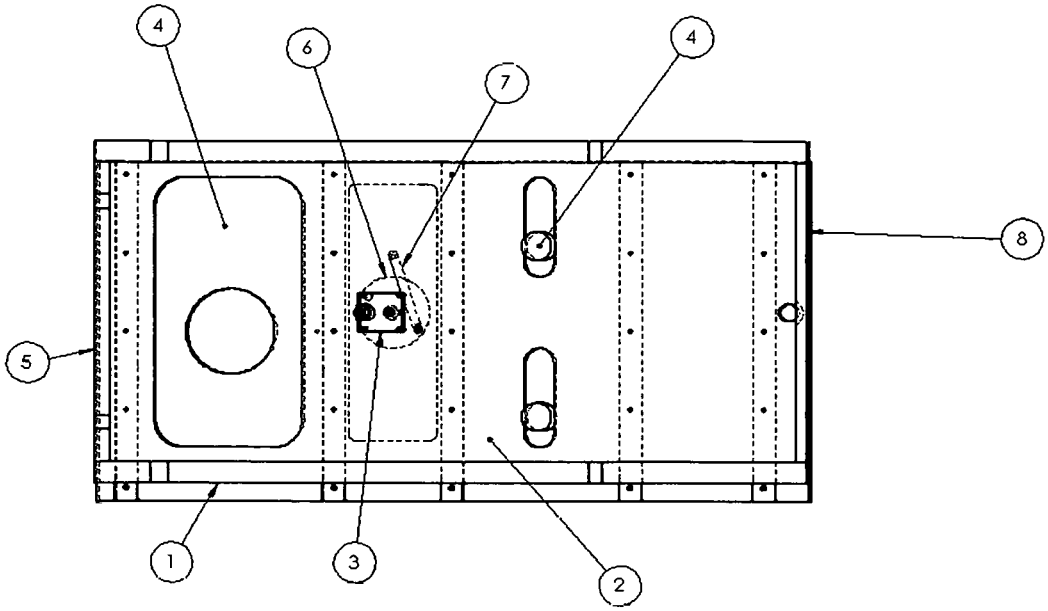
FIG. 2A is the bottom view of the "Horizontal" assembly with call-outs.
Figure 2B:
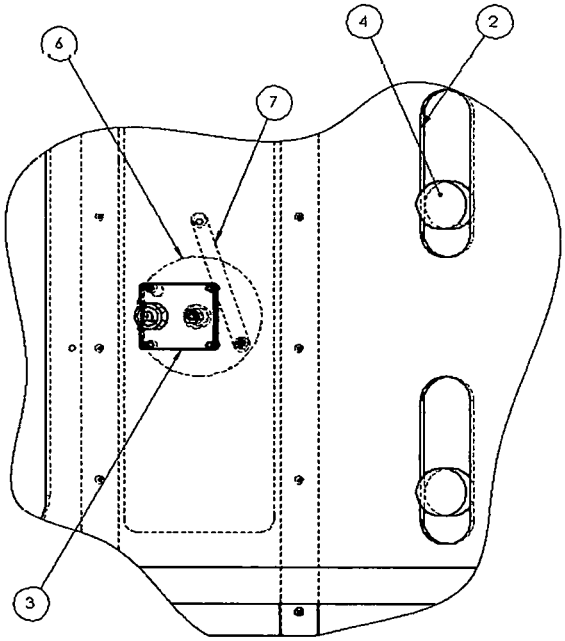
FIG. 2B is a detailed view of the linkage design that results in the "Horizontal" oscillating motion with call-outs.

FIG. 2 shows the exploded view of the embodiment which results in an oscillating Horizontal motion. In FIG. 2B, Item 6, Flywheel, is attached to the output shaft of Item 3, Motor, to induce a rotary motion of Flywheel. Item 3, Motor is mounted and fixed to Item 2, Sub Board. The Flywheel is joined to Item 7, Link, which allows relational circular motion between Flywheel and Link, and drives the Link smoothly in a circular motion. The opposite end of the Link is connected to the protruding pin in Item 4, Top Board, which allows relational circular motion and drives the Top Board. The Top Board has two protruding pins that align with two horizontally aligned slots in Item 2, Sub Board. These pins are aligned with the slots, which allow the pins to slide freely in the slots located in Item 2, Sub Board, which results in an oscillating Horizontal motion of the circular shaped opening in Item 4, Top Board.

All these elements together create an Oscillating Horizontal motion of the circular shaped opening in the Top Board to allow the bag to fall through. Also, the Top Board has a plurality of Item 10, Bar-Slide, Short, which are made from a low friction material to allow smooth motion. Item 2, Sub-Board, has large cut-out in it to allow a bag to fall through easily throughout the Horizontal oscillation motion of the Top Board.

Figure 3:
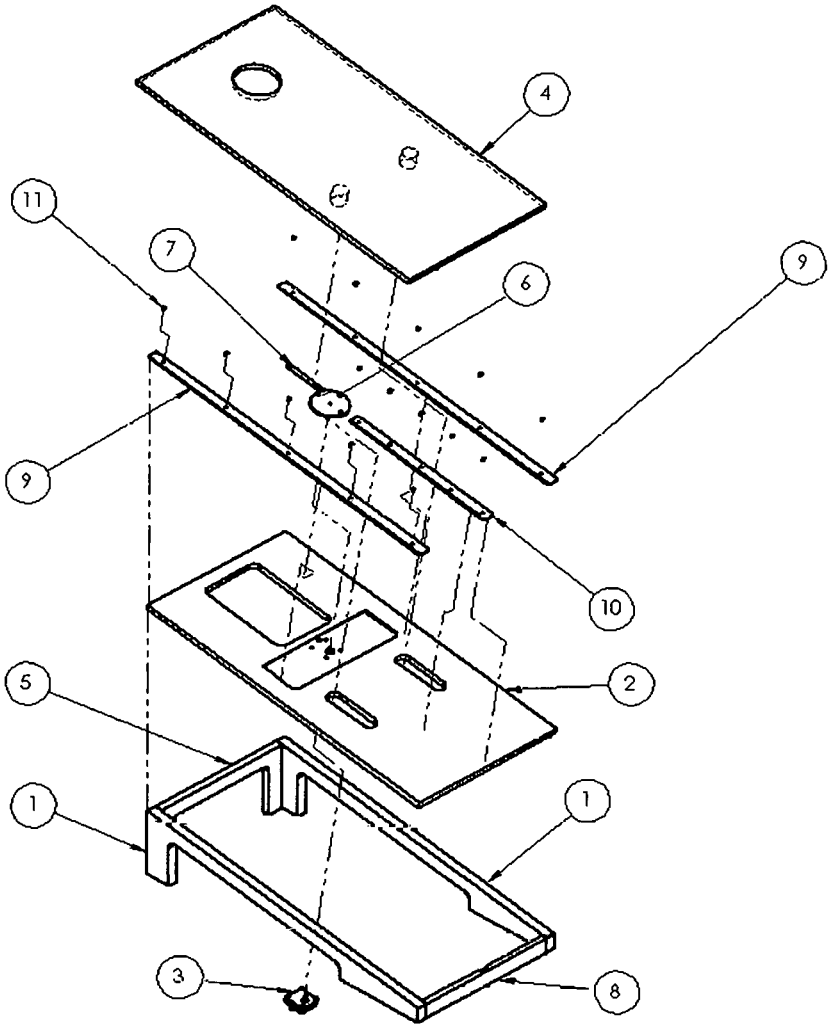
FIG. 3 is an exploded assembly depicting the "Vertical" oscillating motion with item call-outs.
Figure 3A:
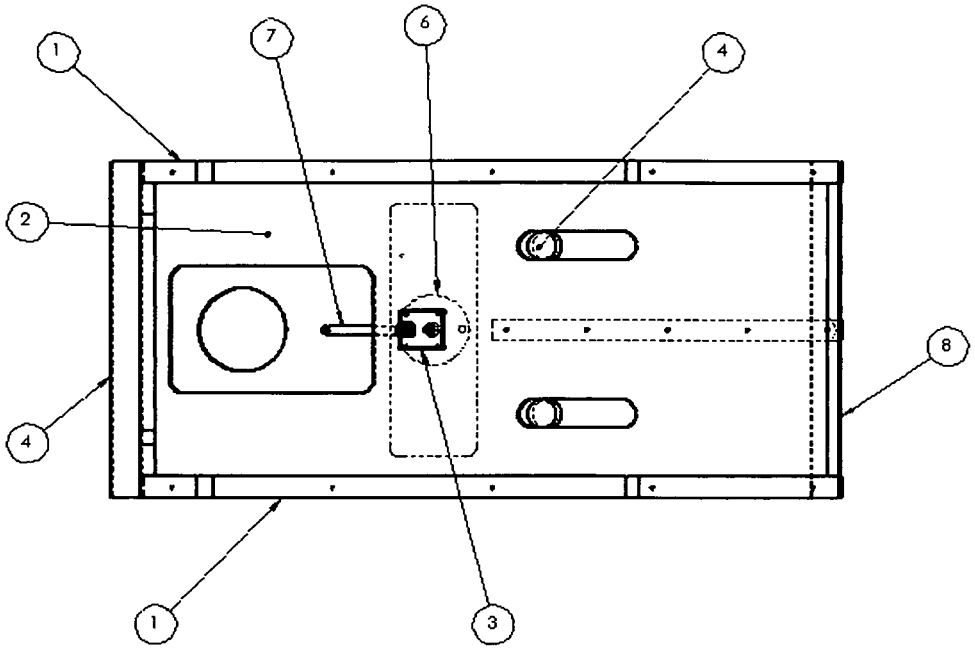
FIG. 3A is the bottom view of the "Vertical" assembly with call-outs.
Figure 3B:
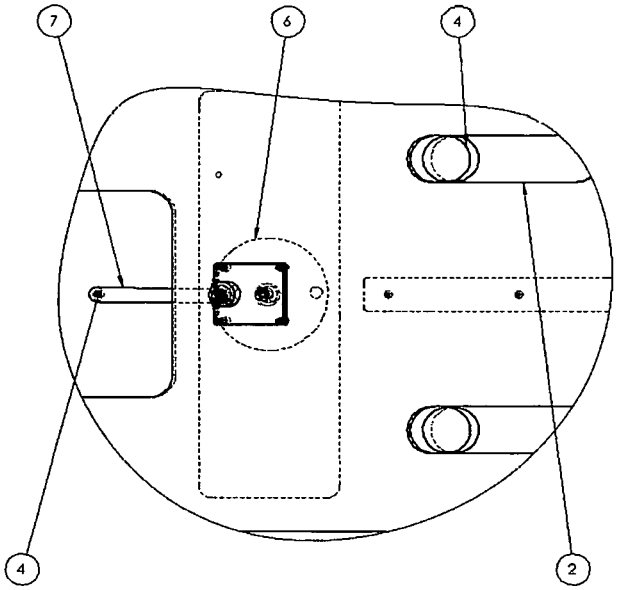
FIG. 3B is a detailed view of the linkage design that results in the "Vertical" oscillating motion with call-outs.

FIG. 3 shows the exploded view of the embodiment which results in an oscillating Vertical motion. In FIG. 3B, Item 6, Flywheel, is attached to the output shaft of Item 3, Motor, to induce a rotary motion of Flywheel. Item 3, Motor, is mounted and fixed to Item 2, Sub Board. The Flywheel is joined to Item 7, Link, which allows relational circular motion between Flywheel and Link, and drives the Link smoothly in a circular motion. The opposite end of the Link is connected to a protruding pin in Item 4, Top Board, which allows relational circular motion and drives the Top Board. The Top Board has two protruding pins that align with two vertically aligned slots in Item 2, Sub Board. These pins are aligned with the slots that are in Item 2, Sub board, which allows the pins to slide freely in the slots which results in an oscillating Vertical motion of the circular shaped opening in Item 4, Top Board. All these elements together create an Oscillating Vertical motion of the circular shaped opening in the Top Board to allow the bag to fall through. Also, the Item 2, Sub Board has a plurality of Item 9, Bar-Slide, Vertical Version and Item 10, Bar-Slide, Short, attached to it, which are made from a low friction material to allow smooth motion of Item 4, Top Board. Item 2, Sub-Board, has large cut-out in it to allow a bag to fall through easily throughout the Vertical oscillation motion of the Top Board.

It is also possible in these embodiments of the oscillating Horizontal and Vertical motions, to have a circular insert which has the slot feature in the insert which would allow the slot to be aligned in an angular position to generate an oscillating angular motion other than Horizontal or Vertical. That embodiment is not illustrated in this document, but is consistent with the spirit or essential characteristics of the invention described and depicted in this document.

Figure 4:
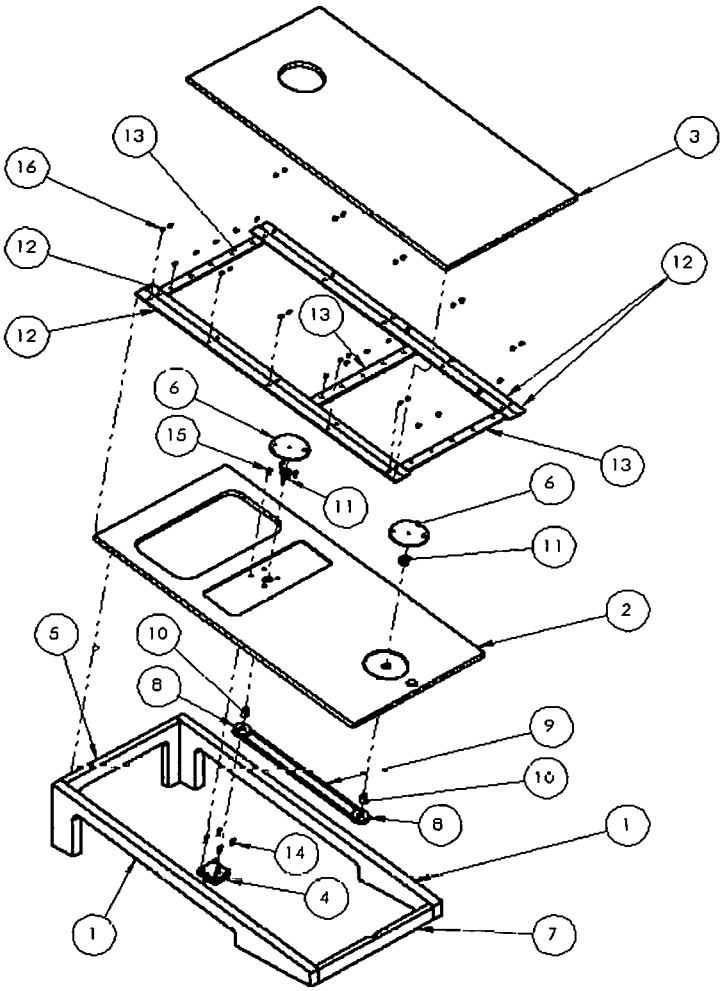
FIG. 4 is an exploded assembly depicting the "Circular" or orbital oscillating motion with item call-outs.
Figure 4A:
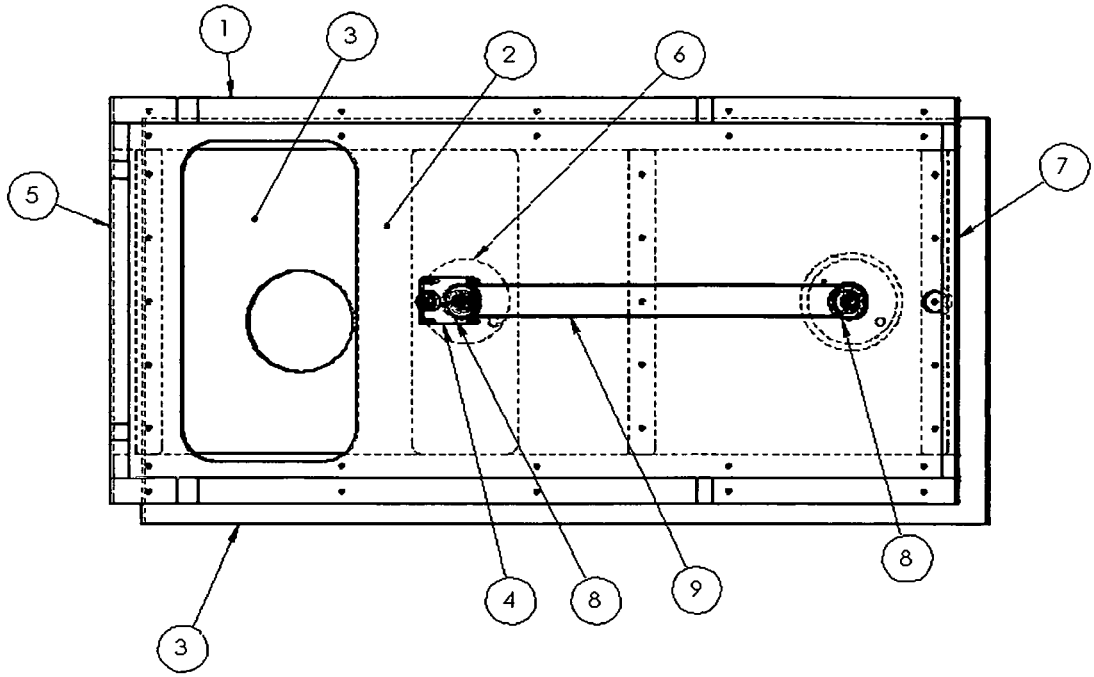
FIG. 4A is the bottom view of the "Circular" or orbital oscillating motion assembly with call-outs.
Figure 4B:
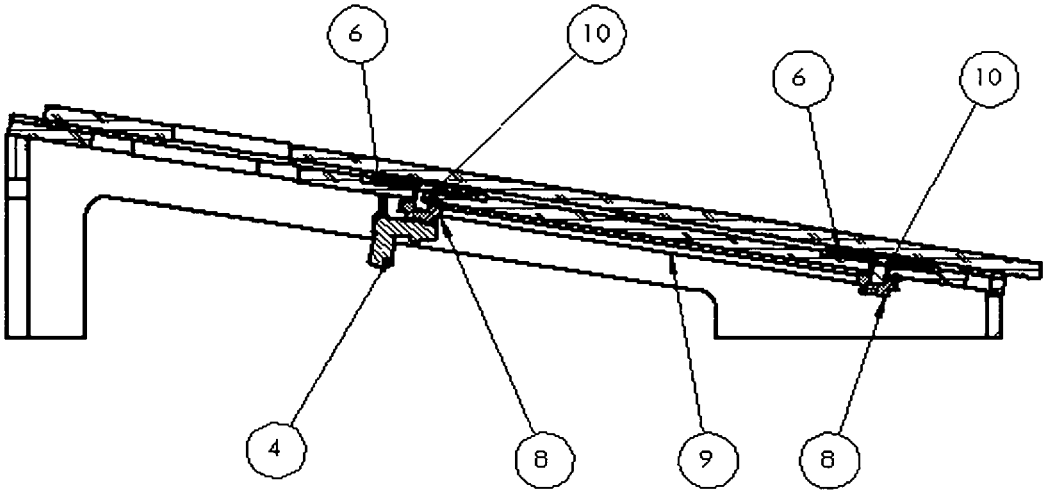
FIG. 4B is a detailed section view of the design that results in the "Circular" or orbital oscillating motion with call-outs.

FIG. 4 shows the exploded view of the embodiment which results in an oscillating Circular or Orbital motion. FIG. 4B shows the cross sectional view of the assembly. Item 4, Motor, is coupled to Item 10, Connecting Shaft Adapter, coaxially to output shaft of Motor and fixed, that enables rotational transmission of movement from Motor output shaft to Connecting Shaft Adapter. Item 6, Flywheel, and Item 8, Pulley, are coupled coaxially and fixed to Item 10, Connecting Shaft Adapter, which transmits rotational movement from Item 4, Motor's output shaft. FIG. 4A shows the bottom view of the assembly. Item 4, Motor, is mounted and fixed to Item 2, Sub Board. Item 6, Flywheel is connected to the protruding pin on Item 3, Top Board, which allows relational circular motion between Flywheel and Top Board, and transmits rotational motion to Top Board. Also, Item 9, Timing Belt, is attached to Item 8, Pulley, which has rotational motion transmitted via Item 10, Connecting Shaft Adapter. Item 8, Pulley transmits motion to Item 9, Timing Belt, which is connected to another Item 8, Pulley, aligned linearly at some linear distance from Item 4, Motor. In this distal location of Item 8, Pulley, it is coupled with Item 10, Connecting Shaft Adapter, coaxially and fixed.

Figure 4C:
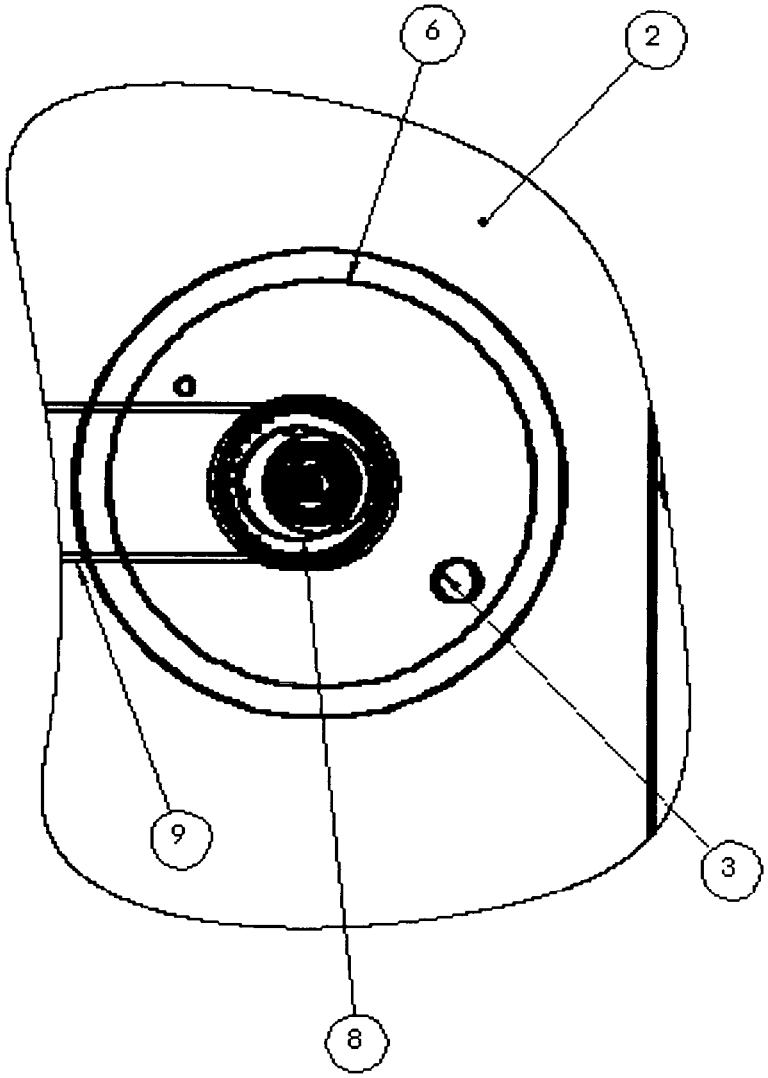
FIG. 4C is a detailed enlarged view of the design that results in the "Circular" or orbital oscillating motion with call-outs.

Pulley transmits rotational motion to Connecting Shaft Adapter. Item 6, Flywheel is coupled to Item 10, Connecting Shaft Adapter, coaxially and fixed, so they rotate in unison. FIG. 4C Item 6, Flywheel, is connected to the protruding pin on Item 3, Top Board, which allows relational circular motion between Flywheel and Top Board, and transmits rotational motion to Top Board. Item 10, Connecting Shaft Adapter, passes through coaxially, in both instances, Item 11, Bearing, and is pressed and fixed into Item 2, Sub Board. Item 6, Flywheel is connected to the protruding pin on Item 3, Top Board, which allows relational circular motion between Flywheel and Top Board, and transmits rotational motion to Top Board. All these elements together create a synchronous rotation of both Flywheels, through the transmission of motion through Item 9, Timing Belt, to Item 8, Pulley, and both Pulleys, which are located and fixed through the Sub Board, are synchronized in their radial alignment throughout their rotation cycles. This allows for Item 6 in both locations to have synchronized radial alignment throughout their rotation cycles. Now the circular opening in Item 3, Top Board, will move in a continuous, Circular Oscillating motion. Also, the Item 2, Sub Board, has a plurality of Item 12, Bar-Slide, Vertical Version and Item 13, Bar-Slide, Short, attached to it, which are made from a low friction material to allow smooth motion of Item 13, Top Board. Item 2, Sub-Board, has large cut-out in it to allow a bag to fall through easily throughout the Circular oscillation motion of Top Board.

The present invention shown here may be embodied in other specific forms without departing from its spirit or essential characteristics. The four embodiments herein are shown to address some of the different embodiments, but are not intended to limit the scope of the invention and are for illustrative purposes only.

What is claimed is:

1. A toss game assembly for one or more players comprising of a framework supporting an angled sub board that interacts mechanically with a movable top board through a plurality of mechanical linkages to create a plurality of single oscillating motions comprising:

the top board driven by a link that is connected to a fly wheel driven by a device mounted to the sub board, a pin in the top board interacts with a bearing placed in the sub board allowing the top board to pivot and move in a swinging arc motion or the top board is driven by a link that is connected to a fly wheel driven by a device mounted to the sub board, two pins mounted in the top board align with two horizontal slots in the sub board, the horizontal slots guiding the two pins when the link is actuated by the flywheel, thereby resulting in a single horizontal oscillating motion of the top board or the top board is driven by a link that is connected to a fly wheel driven by a device mounted to the sub board, two pins mounted in the top board align with two vertical slots in the sub board, the vertical slots guiding the two pins when the link is actuated by the flywheel, thereby resulting in a single vertical oscillating motion of the top board or the top board is driven by two flywheels, one flywheel mounted on a drive shaft driven by a device mounted to the sub board and the other flywheel mounted on a second drive shaft that is located on the sub board, each of the two flywheels having a hole and transferring motion to the top board through a pin mounted on the top board, said drive shaft having a timing pulley affixed to it and said second drive shaft having a second timing pulley affixed to it, said timing pulley and said second timing pulley are connected by a timing belt which allows synchronized rotation of each of the two flywheels, wherein the rotation of the flywheel driven by the device mounted to the sub board is transferred to the second drive shaft via the timing pulley and second timing pulley, thereby resulting in a single orbital oscillating motion of the top boards the framework comprising of two side frames, a front frame and a rear frame, the top board having a circular shaped opening of a size and shape allowing a tossed object to pass and fall through, the sub board is attached to the framework and has an opening that allows the tossed object to pass through the circular opening in the top board in one of the oscillating motions detailed above.

2. The toss game assembly of claim 1, further comprising a bean bag or any type of tossed object that is sized appropriately to pass through the hole of the top board and the opening in the sub board.

3. The toss game assembly of claim 1, further comprising the device mounted to the sub board is able to be set at a constant velocity, set to a different constant velocity or set to a variable velocity.

* * * * *